US006683519B1

(12) United States Patent
Schanzel et al.

(10) Patent No.: US 6,683,519 B1
(45) Date of Patent: Jan. 27, 2004

(54) ACTUATION DEVICE

(75) Inventors: Rainer Schanzel, Essingen (DE); Ottokar Haug, Waldstetten (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 19 days.

(21) Appl. No.: 10/168,890

(22) PCT Filed: Nov. 3, 2000

(86) PCT No.: PCT/EP00/10868

§ 371 (c)(1),
(2), (4) Date: Jun. 21, 2002

(87) PCT Pub. No.: WO01/46970

PCT Pub. Date: Jun. 28, 2001

(30) Foreign Application Priority Data

Dec. 22, 1999 (DE) ..... 199 61 978

(51) Int. Cl.[7] ..... H01F 7/08
(52) U.S. Cl. ..... 335/258
(58) Field of Search ..... 335/258, 273, 335/255, 274

(56) References Cited

U.S. PATENT DOCUMENTS

| | | | |
|---|---|---|---|
| 1,389,056 A | 8/1921 | Lane | |
| 4,594,980 A | 6/1986 | Detweiler | |
| 4,635,683 A | 1/1987 | Nielsen | |
| 5,029,807 A | 7/1991 | Fuchs | |

FOREIGN PATENT DOCUMENTS

| | | |
|---|---|---|
| CH | 169840 | 6/1934 |
| DE | 1 911 603 | 9/1970 |
| DE | 1 465 886 | 2/1971 |
| DE | 32 33 269 | 3/1984 |
| DE | 198 21 806 | 11/1999 |
| EP | 0 270 536 | 6/1988 |
| WO | WO 87/00963 | 2/1987 |

*Primary Examiner*—Chau N. Nguyen
(74) *Attorney, Agent, or Firm*—Kenyon & Kenyon

(57) ABSTRACT

An actuation device, e.g., with actuation by an electromagnet, includes an adjustable part, e.g., a return plate, which is secured to a housing by a return spring, and a fixed part, e.g., a magnet core. The return spring is secured to a pin, and the adjustable part, e.g., return plate, is connected to the pin. The pin has a collar. The return spring is clamped in between the collar and a spring which bears against the adjustable part. In the non-actuated state there is a precisely determined basic air gap between the adjustable part and the fixed part. The collar may be adjusted on the pin. This is achieved in that the adjustable collar is formed by a nut which may be adjusted by a thread which is arranged on the pin. The nut may also be replaced by an adjustment element which may be secured, for example, a pressed-on ring.

9 Claims, 1 Drawing Sheet

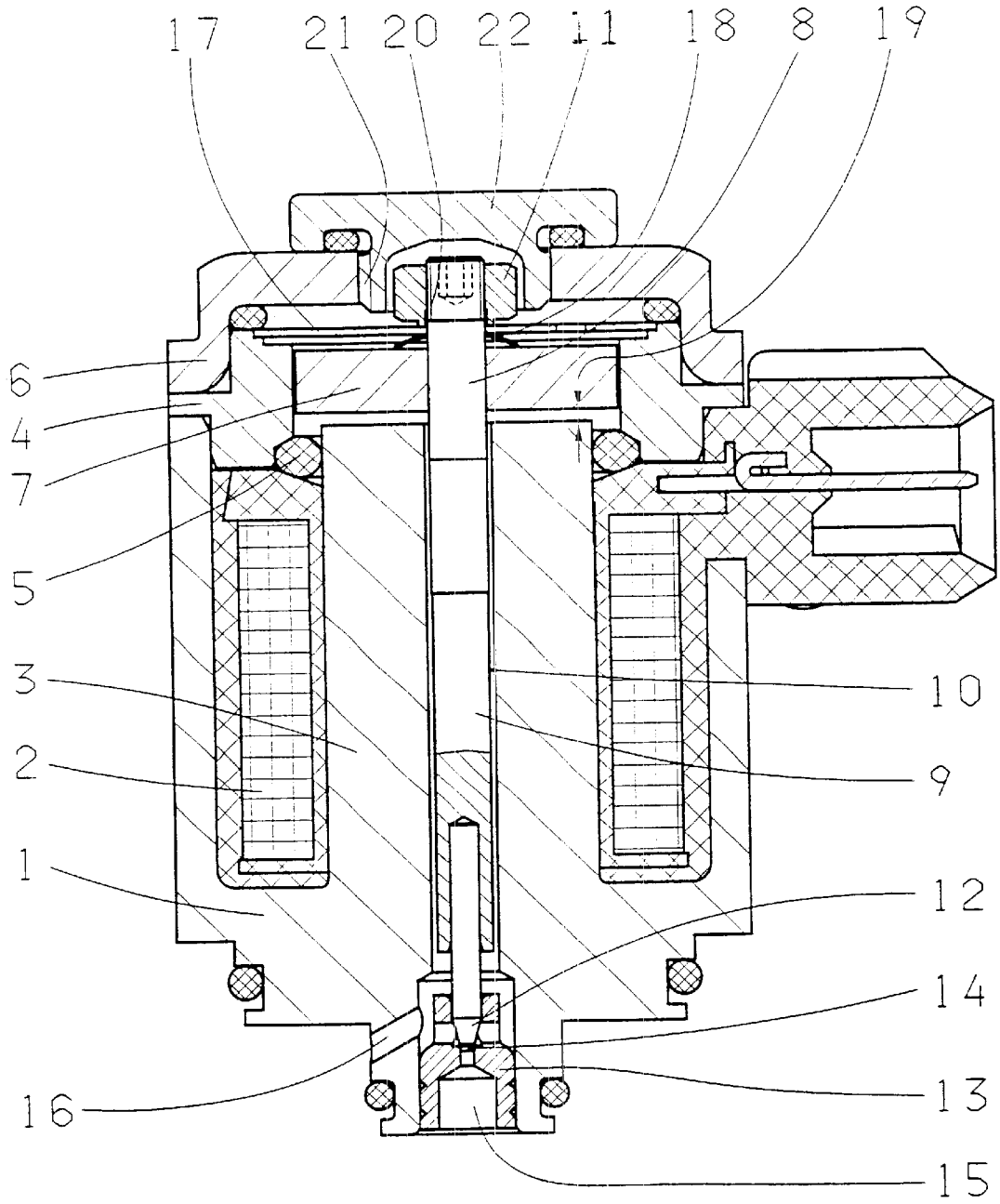
Fig.

ACTUATION DEVICE

FIELD OF THE INVENTION

The present invention relates to an actuation device, in particular with actuation by an electromagnet.

BACKGROUND INFORMATION

European Published Patent Application No. 0 270 536 describes an actuation device for a valve which can be actuated electrically and with which a precisely predeterminable parameter can be obtained despite the use of components with customary tolerances of the basic air gap. For this purpose, a return plate is secured, as an adjustable part, to a housing by means of a return spring. The actuation device contains a magnet core as a fixed part. The return spring is secured to a pin and the adjustable part is connected to the pin. The pin has a collar. The return spring is clamped in between the collar and a spring which bears against the adjustable part. In the non-actuating state there is a precisely determined basic air gap between the adjustable part and the fixed part. The basic air gap can be varied by pressing a suitable connection, for example the pin in the adjustable part, to a greater or lesser extent. In this way, the component tolerances can easily be compensated.

If such an actuation device is installed, for example, in a steering valve, which can be actuated electrically, of a power steering system, in particular of a motor vehicle, it is not possible to change the valve characteristic curve. After the dimensions of the actuation device and of the steering valve have been specified, the valve characteristic curve is definitively specified.

SUMMARY

It is an object of the present invention to provide an actuation device so that it is possible to adjust the valve characteristic curve of a steering valve after the power steering system has been mounted.

The above and other beneficial objects of the present invention are achieved by providing an actuation device as described herein. By providing an adjustable collar, the basic air gap may be adjusted even after the actuation device is mounted, for example, in an electro-hydraulic transducer of a steering valve. In this manner, the valve characteristic curve may be adjusted and a narrower tolerance band may be achieved at the steering valve. The valve characteristic curve may be placed in a certain, desired tolerance range.

The adjustable collar may easily be formed by a nut which may be adjusted by a thread which is arranged on the pin. In order to be able to set the basic air gap when the steering valve is completely mounted, an opening is provided in the closure cover, which may be closed off by a cover. The nut of the collar is easily accessible through the opening.

The present invention is explained in more detail below with reference to an example embodiment illustrated in a drawing.

BRIEF DESCRIPTION OF THE DRAWING

The FIGURE is a cross-sectional view through an actuation device according to the present invention for a valve which may be actuated electrically.

DETAILED DESCRIPTION

A magnet coil 2, which surrounds a magnet core 3, is accommodated in an essentially pot-shaped housing 1. An intermediate cover 4 secures the magnet coil 2 in the housing 1. In addition, the intermediate cover 4 secures a sealing ring 5 in order to seal off the magnet coil 2 from the other spaces of the valve. The housing 1 is closed off by a closure cover 6. A return plate 7 which may be actuated by the magnetic field of the magnet coil 2 is located on one of the sides of the magnet coil 2 and is connected to a pin 8. The pin 8 is composed of non-magnetizable material and has a prolongation in the form of an actuation pin 9. The actuation pin 9 extends to the other side of the magnet coil 2 through an opening 10 in the magnet core 3. At its one end which is adjacent to the return plate 7, the pin 8 has a collar 11. At the opposite end, the actuation pin 9 has a valve cone 12, which, together with a valve seat 13, forms a throttle point 14. The throttle point 14 is arranged between an inflow port 15 and a return flow port 16.

The return plate 7 constitutes the adjustable part of the actuation device, while the magnet core 3 forms the fixed part.

In the housing 1, at the return plate 7 end a return spring 17 in the form of a curved washer is held at its outer circumference in the axial direction. At its radial inner clamping point, the return spring 17 is secured so that it bears against the collar 11 by a spring 18 which is arranged between the return plate 7 and the return spring 17 and is in the form of a disk spring.

In the non-excited state of the magnet coil 2 there is a basic air gap 19 between the magnet core 3 and the return plate 7. In this state, the return plate 7 is held in a force-free state by the return spring 17.

According to the present invention, the collar 11 is of adjustable configuration. This is may be achieved in that the collar 11 is formed by a nut which may be adjusted by a thread 20 which is arranged on the pin 8. As a result, as described in detail above, the basic air gap may be adjusted and thus ultimately the valve characteristic curve in a power steering system may be placed in a desired tolerance range. The nut may also be replaced by another equivalent adjustment element which may be secured, for example, a pressed-on ring.

In order to be able to adjust the basic air gap when the steering valve is completely mounted, an opening 21 which may be closed off by the cover 22, for example, a screw-on cover, is provided in the closure cover 6. The nut of the collar 11 is easily accessible through the opening 21.

Reference Symbols

1 Housing
2 Magnet coil
3 Magnet core (fixed part)
4 Intermediate cover
5 Sealing ring
6 Closure cover
7 Return plate (adjustable part)
8 Pin
9 Actuation pin
10 Opening
11 Collar
12 Valve cone
13 Valve seat
14 Throttle point
15 Inflow port
16 Return flow port
17 Return spring
18 Spring
19 Basic air gap

20 Thread
21 Opening
22 Cover

What is claimed is:

1. An actuation device, comprising:

a housing;

a pin having an adjustable collar;

a return spring secured to the pin;

an adjustable part secured to the housing by the return spring and connected to the pin;

a second spring arranged to bear against the adjustable part, the return spring clamped between the collar and the second spring; and a fixed part;

wherein in a non-actuated state, a precisely determined basic air gap is arranged between the adjustable part and the fixed part.

2. The actuation device according to claim 1, wherein the actuator device is configured to be actuated by an electromagnet.

3. The actuation device according to claim 1, wherein the adjustable part includes a return plate.

4. The actuation device according to claim 1, wherein the fixed part includes a magnet core.

5. The actuation device according to claim 1, wherein the adjustable collar includes a securable adjustment element.

6. The actuation device according to claim 1, wherein the adjustable collar includes a nut configured to be adjusted by a thread arranged on the pin.

7. The actuation device according to claim 1, wherein the adjustable collar includes a pressed-on ring.

8. The actuation device according to claim 1, wherein the return spring includes a curved washer.

9. The actuation device according to claim 1, further comprising:

a closure cover having an opening; and a cover configured to close off the opening.

* * * * *